United States Patent [19]

Stranzinger

[11] 4,198,023

[45] Apr. 15, 1980

[54] STAND FOR CHRISTMAS TREES

[76] Inventor: Hermann Stranzinger, Osterreich, A 5301 Eugendorf-Schaming, Austria

[21] Appl. No.: 872,681

[22] Filed: Jan. 26, 1978

[30] Foreign Application Priority Data

Jan. 25, 1977 [AT] Austria ..... 441/77

[51] Int. Cl.[2] ..... A47G 33/12

[52] U.S. Cl. ..... 248/523

[58] Field of Search ..... 248/512, 513, 523; 269/279

[56] References Cited

U.S. PATENT DOCUMENTS

| | | | |
|---|---|---|---|
| 10,985 | 3/1854 | Gregg | 269/279 X |
| 17,814 | 7/1857 | Whiton | 269/279 X |
| 1,155,383 | 10/1915 | Tischer | 248/523 |
| 1,858,849 | 5/1932 | Borden | 269/279 X |
| 1,976,878 | 10/1934 | Eden | 269/279 X |
| 2,292,508 | 8/1942 | Black | 248/523 |
| 2,754,075 | 7/1956 | Nelson | 248/523 X |
| 2,879,019 | 3/1959 | Fox | 248/523 |
| 3,547,569 | 12/1970 | Fenton et al. | 248/512 X |
| 3,648,957 | 3/1972 | Bencrisutto | 248/521 |

FOREIGN PATENT DOCUMENTS

| | | | |
|---|---|---|---|
| 490372 | 2/1959 | Canada | 248/523 |

*Primary Examiner*—William H. Schultz
*Attorney, Agent, or Firm*—Kurt Kelman

[57] ABSTRACT

A baseplate has an upper surface which is formed with a recess that has substantially the configuration of a figure eight. The baseplate is also formed with a hole, which opens into said recess and which has a vertical axis disposed at the center of said recess. Two identical discs are disposed in said recess on opposite sides of said hole. Each of said discs is formed in its periphery with a plurality of recesses having the configuration of arcs of circles differing in radius. The hole has a radius which is equal to the largest radius of said recesses of said discs.

1 Claim, 2 Drawing Figures

STAND FOR CHRISTMAS TREES

Figure 1:
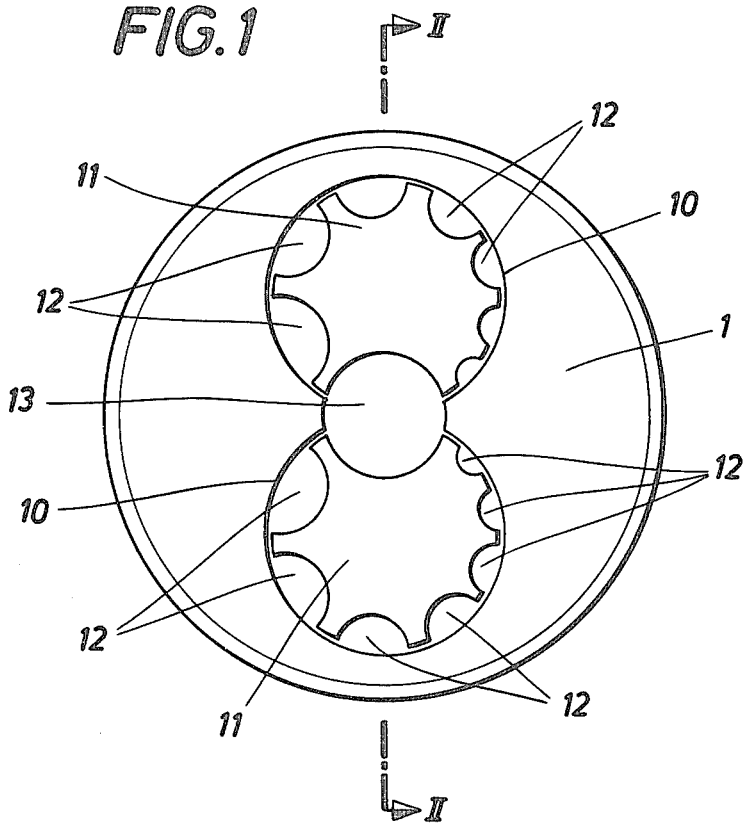

This invention relates to a stand for Christmas trees or the like, comprising a baseplate and a holder which is adapted to receive a tree trunk or shaft and is adaptable to tree trunks or shafts differing in diameter.

Such stands for Christmas trees or the like have previously been provided with interfittable sleeves, the largest of which is fitted in the baseplate so that the size of the holder can be adapted to tree trunks or shafts differing in thickness in that a proper number of sleeves are used. Because these sleeves engage the tree trunk or shaft only on a small surface, it is difficult to pull the sleeves from the tree trunk or shaft. Besides, it is difficulty to interfit the sleeves and to pull them apart because they are such a close fit with each other that they tend to be jammed when they are even slightly soiled or deformed. Moreover, a plurality of sleeves must be available so that the sleeves which are not used at a time may easily be lost. Whereas the baseplate itself may constitute a holder which is adaptable to tree trunks or shafts which differ in diameter if the baseplate is formed with a plurality of holes differing in diameter, only one of these holes, at best, can be disposed at the center of the baseplate so that the tree trunks or shafts must be eccentrically inserted into the bottom plate in most cases although such an arrangement is not pleasing in appearance and tends to tilt easily.

It is an object of the invention to eliminate these disadvantages and to provide for Christmas trees or the like a stand which is of the kind described first hereinbefore and which has a holder that is centrally disposed in the baseplate and can be adapted in a particularly simple and convenient manner to tree trunks or shafts which differ greatly in diameter so that the stand can be used not only as a stand for Christmas trees but also as a stand for sunshades, clothesline posts, signboards etc.

This object is accomplished in accordance with the invention in that the baseplate is formed in its upper surface with a figure eight-shaped recess, which accommodates two identical discs, each of which is formed in its periphery with arcuate recesses having different radii, and the baseplate is formed with a hole, which is disposed at the center of said recess and has a radius which is equal to the radius of the largest recesses of the discs. The holder is formed by the two disc recesses which register with each other at a time and by the hole in the baseplate. This holder can simply be adapted to the diameter of a given tree trunk or shaft in that the discs are rotated. It will be understood that the discs need not be exactly circular. They might be polygonal and formed with recesses at the sides of the polygon. In that case, the recess in the base plate may have a configuration which corresponds to the configuration of the discs so that the size of the holder can be selected in that the discs are inserted with the proper angular orientation. The discs may be made from plastic material because it is inexpensive and can easily be handled. The heavy baseplate may be made of concrete.

Figure 2:
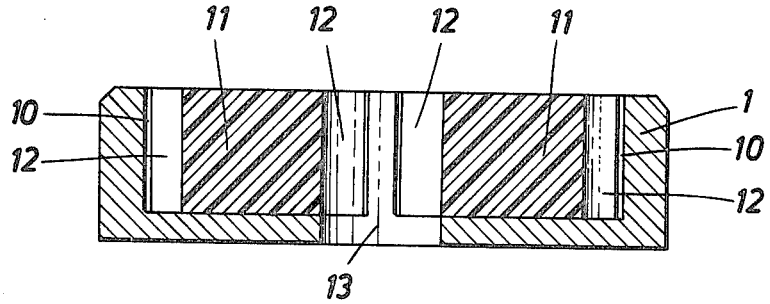

An embodiment of the invention is shown by way of example on the accompanying drawing, in which FIG. 1 is a top plan view showing a Christmas tree stand according to the invention and FIG. 2 is a transverse sectional view taken on line II—II in FIG. 1.

A base plate 1 is formed with a figure eight-shaped recess 10, in which two identical discs 11 of plastic material are rotatably inserted. These discs 11 are provided at their periphery with recesses 12, which have the configuration of circles differing in radii. The baseplate 1 is formed with a through hole 13, which has a vertical axis disposed at the center of the recess 10, and a radius which is equal to the radius of the largest recesses in the discs. A holder for a tree trunk or shaft is formed in that two identical recesses are arranged in registry with each other. As a result, the holder can easily be adapted to a tree trunk or shaft having a given diameter in that the discs 11 are rotated. A tree trunk or shaft which has been inserted into the hole 13 and is engaged by the discs in the recesses thereof will be held by the stand with excellent stability.

What is claimed is:

1. A stand for a Christmas tree, comprising (a) baseplate having a vertical axis, the baseplate defining (1) two identical circular recesses, each of the circular recesses having a stationary vertical axis and the axes of the baseplate and the circular recesses defining a diametrical plane of the baseplate, and (2) another circular recess of smaller diameter interconnecting the two circular recesses, the other circular recess having an axis coincident with the axis of the baseplate, and the recesses being stationary in the baseplate, and (b) two identical discs disposed rotatably in the identical circular recesses for rotation about the respective stationary axes thereof, (1) each disc defining a plurality of peripheral arcuate recesses of differing radii, and (2) the radius of the other circular recess being equal to the largest radius of the arcuate recesses in the disc.

* * * * *